US007866074B2

(12) United States Patent
McComb et al.

(10) Patent No.: US 7,866,074 B2
(45) Date of Patent: Jan. 11, 2011

(54) COLLAPSIBLE FREESTANDING DRAWING BOARD

(75) Inventors: Heather McComb, Bethlehem, PA (US); Dexter Liu, Portsmouth, RI (US); Paul Snyder, Allentown, PA (US)

(73) Assignee: Crayola LLC, Easton, PA (US)

( * ) Notice: Subject to any disclaimer, the term of this patent is extended or adjusted under 35 U.S.C. 154(b) by 1006 days.

(21) Appl. No.: 11/354,455

(22) Filed: Feb. 15, 2006

(65) Prior Publication Data

US 2006/0216686 A1 Sep. 28, 2006

Related U.S. Application Data

(60) Provisional application No. 60/652,948, filed on Feb. 15, 2005.

(51) Int. Cl.
*A47G 5/00* (2006.01)

(52) U.S. Cl. ..... 40/606.01; 160/135; 40/610

(58) Field of Classification Search ..... 40/657, 40/610, 603, 604; 160/135; 434/408–425
See application file for complete search history.

(56) References Cited

U.S. PATENT DOCUMENTS

| | | | | | |
|---|---|---|---|---|---|
| 467,561 | A * | 1/1892 | Rohlen | 40/780 |
| 1,598,438 | A * | 8/1926 | Hallowell | 40/606.01 |
| 2,571,382 | A * | 10/1951 | Raven | 403/190 |
| 3,017,969 | A * | 1/1962 | Nielsen | 52/239 |
| 3,494,405 | A * | 2/1970 | Bartelmas et al. | 160/24 |
| 3,583,466 | A * | 6/1971 | Dreyer | 160/351 |
| 3,868,630 | A * | 2/1975 | Lesondak | 340/908.1 |
| 3,962,827 | A * | 6/1976 | Chaffee | 49/384 |
| D279,942 | S * | 8/1985 | Vasquez et al. | D6/332 |
| 4,842,035 | A * | 6/1989 | Thompson | 160/135 |
| 5,083,390 | A * | 1/1992 | Edman | 40/607.02 |
| 5,878,802 | A * | 3/1999 | Richter et al. | 160/135 |
| 6,348,028 | B1 * | 2/2002 | Cragg | 482/148 |
| 6,370,803 | B1 * | 4/2002 | Burquest | 40/607.04 |
| 6,598,649 | B1 * | 7/2003 | Moore et al. | 160/135 |

* cited by examiner

*Primary Examiner*—Cassandra Davis
(74) *Attorney, Agent, or Firm*—Shook, Hardy & Bacon LLP

(57) ABSTRACT

A collapsible, freestanding oversized drawing board including a frame comprised of a plurality of frame members, a drawing sheet, and attachments to the frame. Specifically, the sheet can be drawn on, painted on, washed, or receive magnets.

16 Claims, 5 Drawing Sheets

COLLAPSIBLE FREESTANDING DRAWING BOARD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to the field of drawing boards, and, in particular, to a new and useful activity sheet held within a collapsible and freestanding frame.

2. Description of the Prior Art

Drawing boards are well known in the prior art and common in today's world. Chalkboards, dry erase boards, and other conventional drawing boards provide an educational and entertaining device for children. Conventional boards typically comprise a wooden, plastic, or metallic planar surface coated with a composition upon which one can write or draw. Larger drawing boards are typically heavy and cumbersome. As a result, it is difficult to provide children with large drawing surfaces that are also lightweight and easily transportable.

In general, today's boards are supported by a freestanding frame, held by an easel, or mounted onto a wall. As a result, storing traditional boards is problematic. Many freestanding frames cannot be collapsed and require substantial space for storage. Easels tend to only provide limited collapsibility. Wall mounted boards necessitate large spaces to accommodate near permanent fixtures.

BRIEF SUMMARY OF THE INVENTION

The present invention is directed to a collapsible freestanding drawing board having a frame comprising frame members selectively coupleable to one another, and a sheet member supported by the frame such that the sheet member is stretched taught within the frame and supported in a generally vertical orientation. In an exemplary embodiment, the frame is operably configured to receive attachments, such as games and accessories.

DETAILED DESCRIPTION OF THE PREFERRED EMBODIMENTS

The various embodiments of the present invention will be better understood from the detailed description provided below and from the accompanying drawings of various embodiments of the invention. However, the detailed description and drawings should not be read to limit the invention to the specified embodiments. Rather, these specifics are provided for explanatory purposes to help the invention be better understood.

Figure 1:
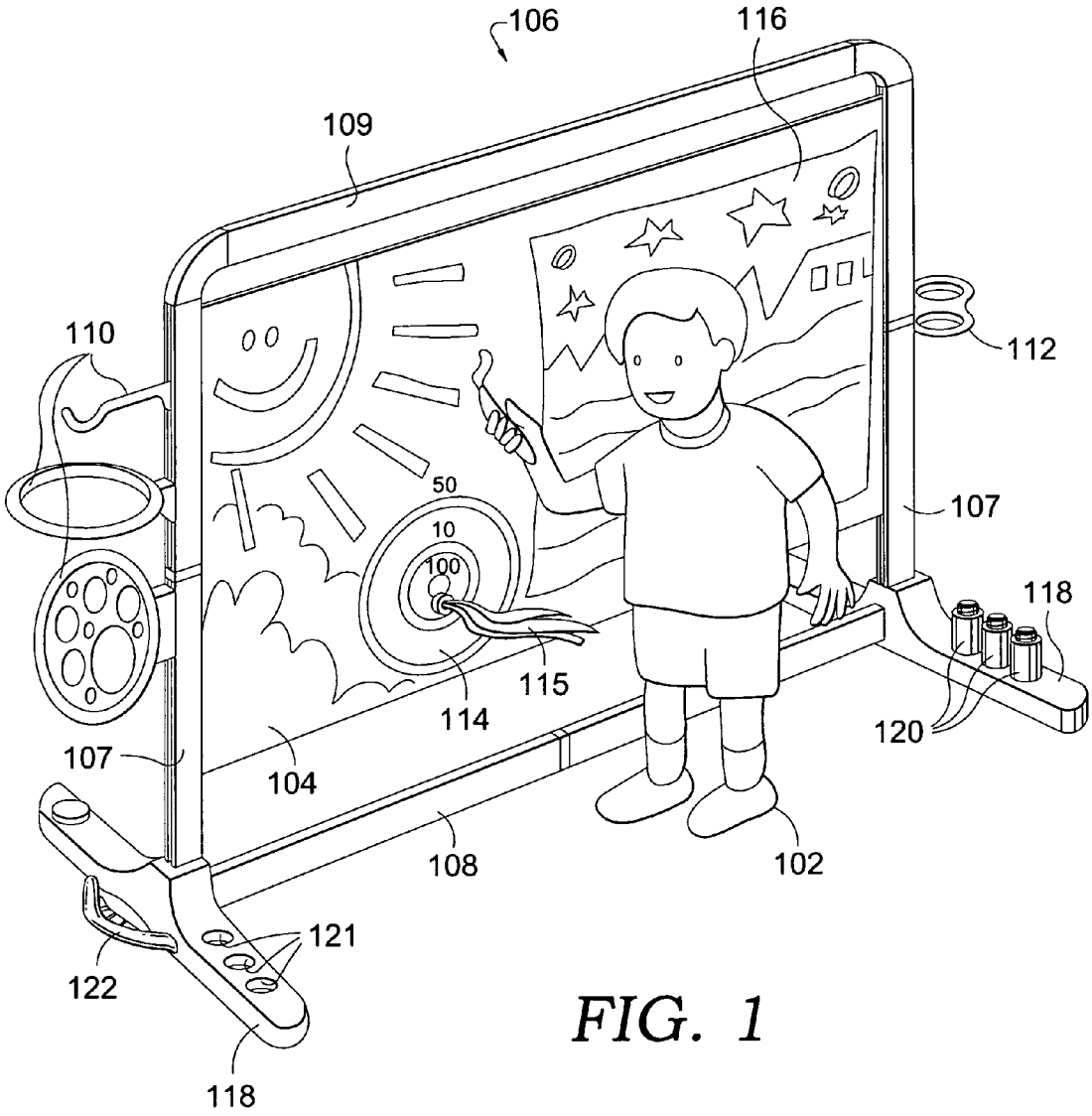
FIG. 1 illustrates a perspective view of an exemplary embodiment of the present invention.

FIG. 1 illustrates a collapsible, freestanding drawing board of the present invention. As depicted in FIG. 1, a user 102 may paint, mark, draw, hang magnets, or play games on the present invention.

Figure 2:
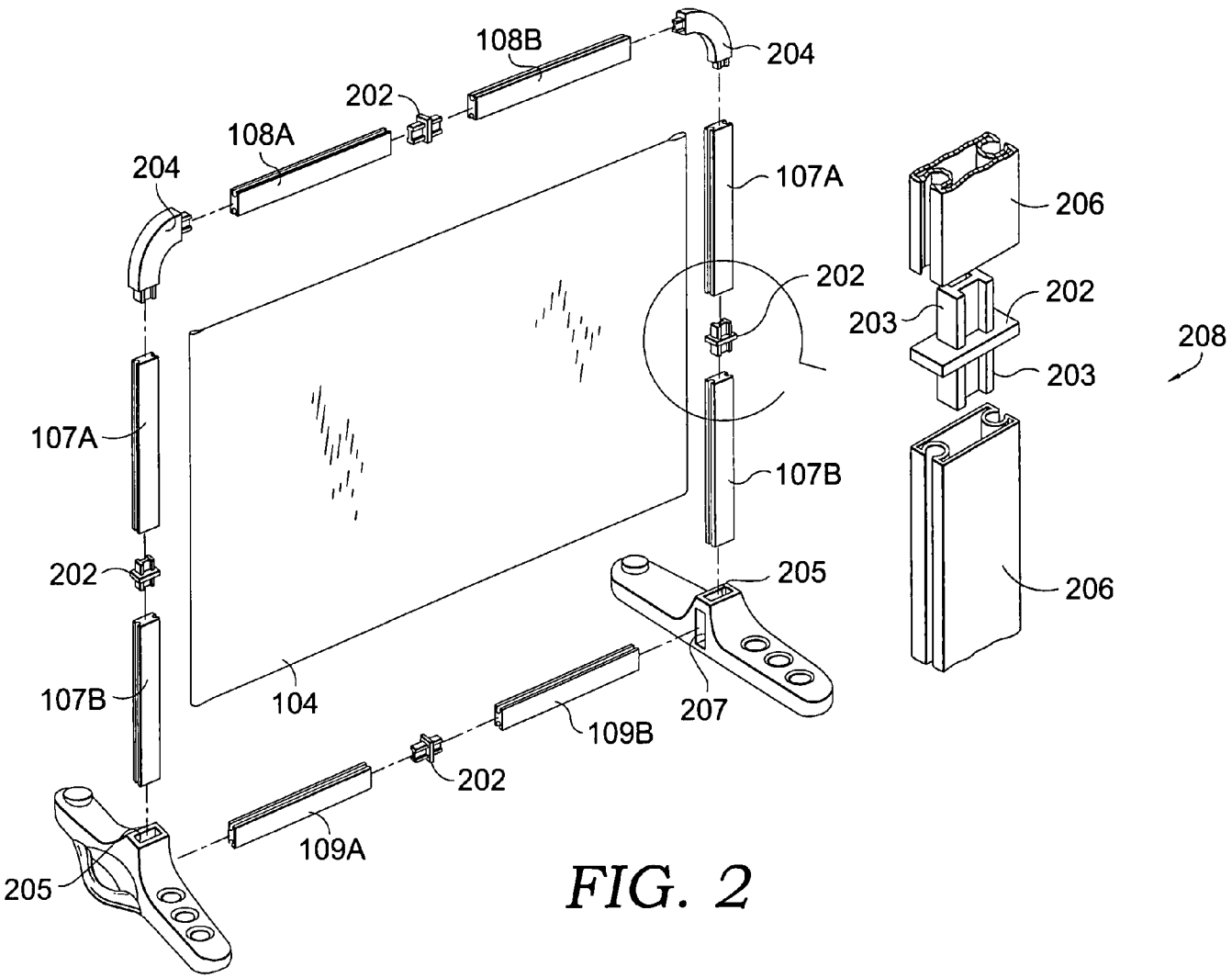
FIG. 2 is an exploded view of the component parts of a collapsible, freestanding drawing board.

The present invention comprises an activity sheet 104 and a freestanding frame, indicated generally at 106, comprising side frame members 107, lower frame member 108, and upper frame member 109. As shown in FIG. 2, each frame member preferably comprises at least two segments (107A, 107B, 108A, 108B, and 109A, 109B) coupled by connectors 202. Connectors 202 are constructed of wood, plastic, metal, or similar material and each connector comprises two elongate male ends 203 extending in opposite directions from a generally rectangular center. Each male end 203 is operably configured to be mateably received within an aperture of an end of each frame member segment. As illustrated in the expanded view at 208, frame member segments are hollow or contain female ends operably configured to receive male ends 203. Connector 202 holds frame member segments together to make up each frame member. In an alternative embodiment, frame members are single segments and not separable.

Figure 3:
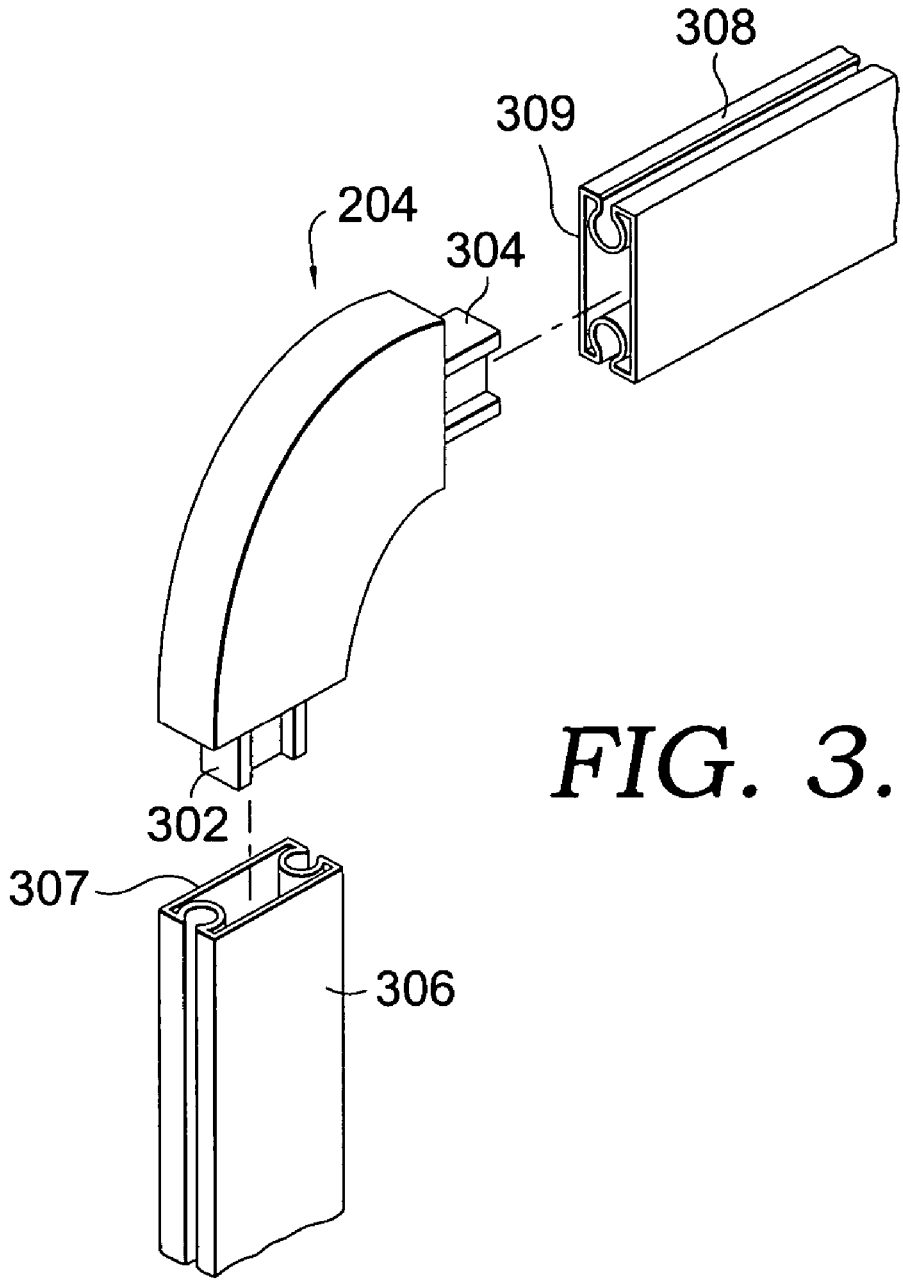
FIG. 3 is a perspective view of an arched frame connector and two frame members, according to an embodiment of the present invention.

Frame members 107, 108, and 109 are preferably lightweight and made of PVC pipe, wood, plastic, metal, or similar materials. The upper ends 306 of side frame members 107 and distal ends 308 of upper frame member 109 are releasably coupleable. In an exemplary embodiment, an arcuate frame connector 204 connects upper ends of side frame members 107 and upper frame member 109. As shown in FIG. 3, frame connector 204 comprises two male ends, 302 and 304 extending in longitudinal planes that are substantially perpendicular. Side frame members 107 and upper frame member 109 are operably configured to have hollow or female distal ends 307, 309 to receive male ends 302 and 304. It is to be understood that other configured connectors (such as U-shaped, L-shaped, or the like) may also be used. In addition, frame members can directly couple together without using connectors. Therefore, FIG. 3, while illustrative, merely provides an exemplary method for coupling frame members and other coupling methods can also be used.

The lower ends of side frame members are received in base 117, which preferably comprises at least two feet 118 that support the frame and sheet 104 in a substantially vertically oriented position. Each foot 118 is formed with a first aperture 205 for receiving the lower end 107B of a side frame member to hold the side frame member in a generally vertical position. Each foot likewise comprises a second aperture 207 for receiving an end of the lower frame member 109A and B, and hold the lower frame member 109 in a generally horizontal position. First and second apertures are operably configured for a friction fit with the ends of the lower and side frame members 107 and 109 to releasably secure the members in the apertures.

Figure 4:
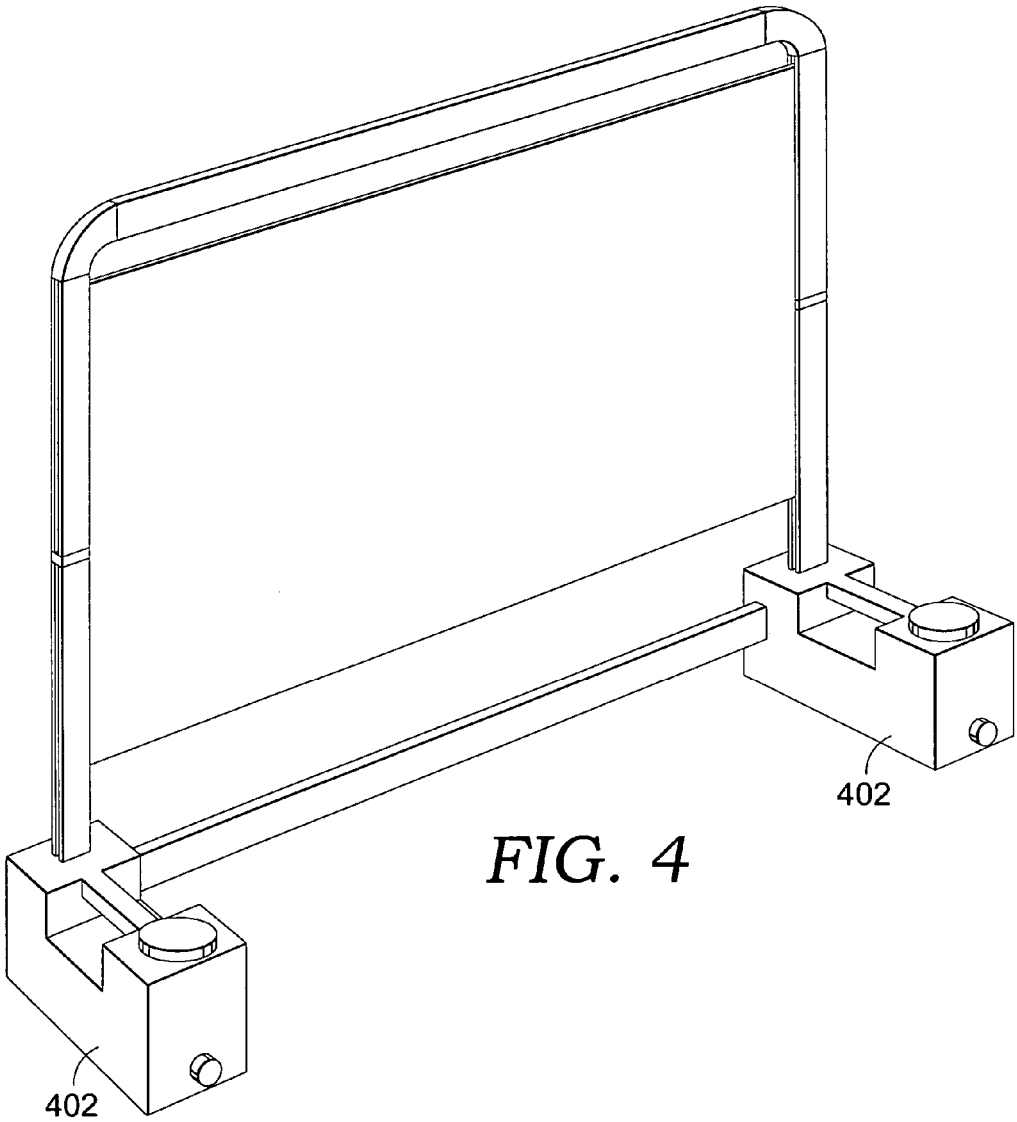
FIG. 4 is a perspective view of a collapsible, freestanding drawing board having a weighted base.
Figure 5:
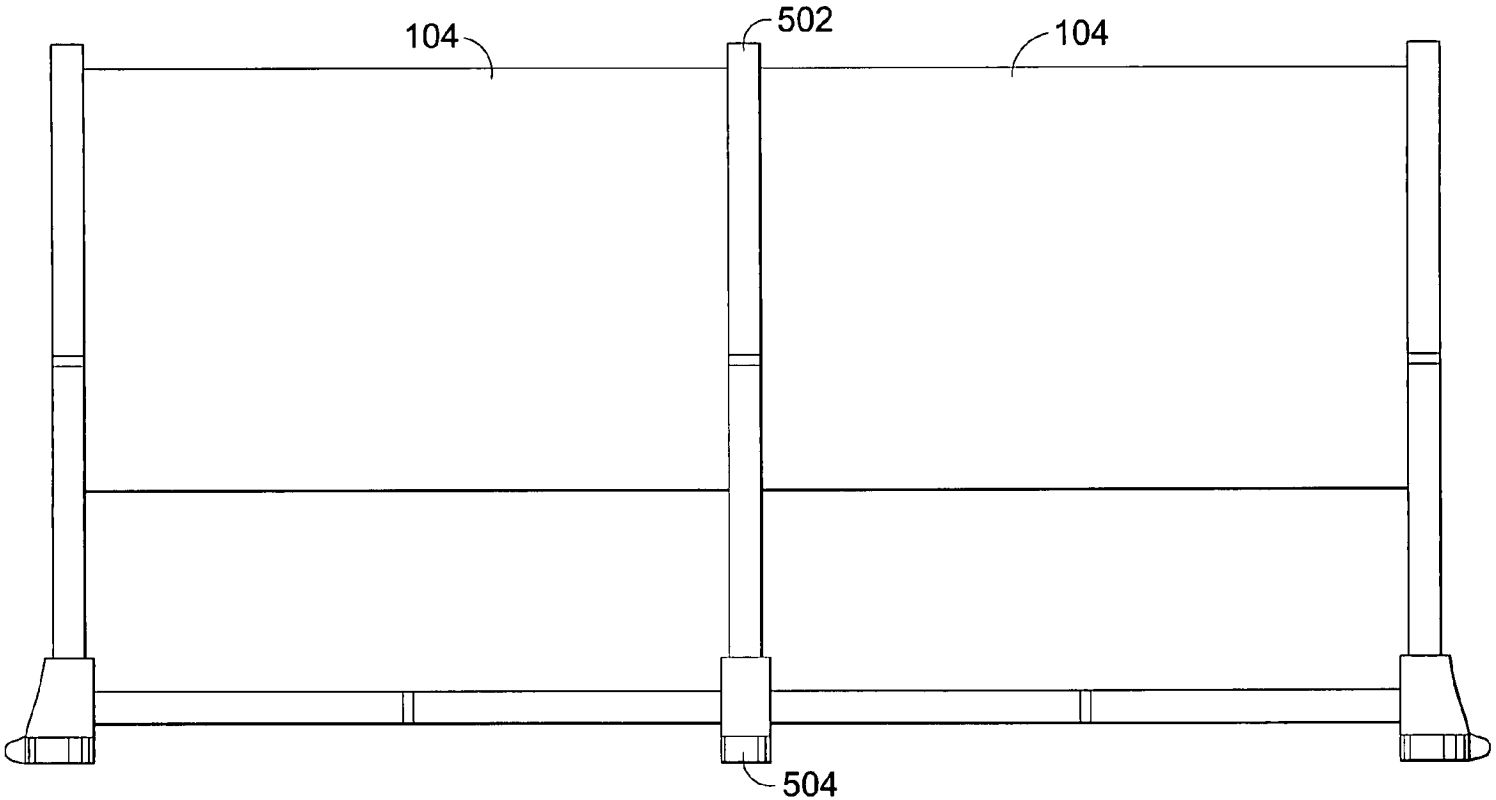
FIG. 5 is a perspective view of two connected collapsible, freestanding drawing boards sharing a longitudinal frame member and base according to an embodiment of the present invention.

As illustrated in FIG. 5, each foot 118 may include another second aperture on the opposite face of foot 118. This aperture is likewise operably configured to secure an end of a lower frame member to provide for a multiple screen embodiment of the present board. Foot 118 may contain features such as handle 122 or paint storage receptacle 120 to hold paint cans 121. Further, each foot 118, as shown in FIG. 4, may include an enclosure 402 for holding sand, water, gravel, or other weighted material to support the frame in an upright position.

Sheet member 104 is relatively light and collapsible. Sheet member 104 is releasably attached to frame 106 and the frame holds sheet 104 in a generally vertical position by stretching sheet 104 between at least two frame members. Preferably, sheet 104 is attached to side frame members 107 and is stretched taught therebetween. In an exemplary embodiment, side frame members include slot 206, which receives and holds a side edge 207 of sheet 104. The side edges 207 of sheet 104 have an enlarged width dimension relative to the remainder of sheet 104. Slot 206 comprises a narrowed entryway and recessed cavity running the length of a frame member. The recessed cavity receives the side edge of sheet 104, and the narrowed entryway is operably configured to retain the enlarged side edge of sheet in the recessed cavity. The enlarged side edges are slideably received in slot 206's recessed cavity and are held in place by the narrowed entryway. In another embodiment, two of sheet 104's edges are looped creating pockets that receive two frame members. Once sheet 104 is attached to at least two frame members, it can be held upright by the frame.

In yet another embodiment, the vertical or horizontal edges of sheet 104 are looped creating pockets that envelop frame members 106 and 107. While the aforementioned embodiments illustrate various ways to stretch sheet 104 within a frame, other well-known coupling methods may also be used.

Sheet 104 is thus easy to store and transport and suitable for repeated painting, marking, drawing, washing, or receiving magnets thereon. In an exemplary embodiment, sheet member 104 is vinyl. In other embodiments, sheet 104 is coated with a composition creating a surface for writing, painting, or receiving magnets. Further, games can be drawn on or attached to sheet 104 in embodiments. For example, dart board 114 affixes to sheet 104 and provides user 102 a target to throw dart 115.

To enrich user 102's learning and educational experience, the frame may receive attachments, such as hoops, cup holders, paint holders, brush holders, marker holders, hooks, rings, and other such accompaniments. Preferably, slots 206 likewise are formed on the opposite face of side frame members 107. Individual attachments, such as game 110 or accessory holder 112, affix to the frame by inserting a male end protruding from the attachment into slot 206 on the frame member. In another embodiment, attachments are held on the frame by magnets. While the aforementioned embodiments illustrate various ways to couple attachments to the frame, other well-known coupling methods can also be used.

Although the present invention has been described with reference to specific exemplary embodiments, it will be evident that various modifications and changes may be made to these embodiments without departing from the broader spirit and scope of the invention. Accordingly, the specification and drawings are to be regarded in an illustrative rather than a restrictive sense.

What is claimed is:

1. A collapsible, freestanding drawing board comprising:

a base having at least two foot members;

a frame mounted to the base, the frame having an upper frame member, a lower frame member and two side frame members, the upper frame member being selectively coupleable to the side frame members, and the lower frame member being releasably secured by the at least two foot members, the side frame members each including a slot extending a distance parallel to a long axis of the side frame members and the slot also extends along a surface facing outwardly from the opposite side frame member, the slot receiving a protrusion on an accessory holder having a enlarged portion that is retainable within the slot to couple the accessory holder to the side frame member;

a sheet member having opposing side edges, wherein attachments affix to the opposing side edges of the sheet member, the sheet member further comprising a flexible fabric that is suitable for repeated uses as a marking surface; and means for coupling the opposing side edges of the sheet member to the frame.

2. The board of claim 1, wherein the means for coupling the sheet member to the frame comprises at least one slot formed in each of at least two opposing frame members for receiving a portion of the sheet, and wherein the portion of the sheet member received in the frame members has an enlarged portion relative to an adjacent portion of the sheet and wherein the enlarged portion of the sheet member has a width dimension greater than a width dimension of a neck of each slot.

3. The board of claim 1, wherein the means for coupling the sheet member to the frame includes at least two longitudinal pockets receiving portions of the sheet member, the at least two longitudinal pockets adjacent a periphery of the sheet member.

4. The board of claim 1, wherein the means for coupling the sheet member with the frame includes at least one lateral pocket receiving portions of the sheet member, the at least one lateral pocket being adjacent a periphery of the sheet member.

5. The board of claim 1, wherein the side frame members are comprised of two or more frame segments and each frame segment are releasably coupleable to a connector.

6. The board of claim 1, wherein each foot member has an enclosure for receiving weighting material.

7. The board of claim 1, wherein the base includes a receptacle for receiving attachments.

8. The board of claim 1, wherein the sheet member is made of a synthetic material.

9. A collapsible, freestanding drawing board comprising:

a base having at least two foot members, at least one of the foot members including one or more storage receptacles integrally formed therein; a frame mounted to the base, the frame having an upper frame member, a lower frame member and two side frame members, the upper frame member being selectively coupleable to the side frame members, and the lower frame member being releasably secured by the at least two foot members, wherein each foot member of the base has a first aperture for receiving the side frame member and securing the side frame member in a substantially vertical position, and wherein each foot member comprises a second apertures, each second aperture operably configured to receive an end of the lower frame member;

a sheet member having opposing side edges and opposing free edges; and means for coupling the opposing side edges of the sheet member to the side frame members; and wherein the one or more storage receptacles are recesses formed on the exterior surface of the at least two foot members configured to receive and store one or more paint container.

10. The board of claim 9, wherein the second aperture is operably configured to receive the lower frame member and secure the lower frame member in a substantially horizontal position, each of the at least two foot members receiving one end of the lower frame member.

11. The board of claim 9, wherein at least one side frame member comprises a slot formed on an outward facing side of the side frame member, the slot being operably configured to receive a portion of a second sheet member.

12. The board of claim 11, wherein the second sheet member is releasably secured in the slot.

13. The board of claim 9, wherein the sheet member further comprises a flexible fabric that is suitable for repeated uses as a marking surface.

14. The board of claim 9, wherein the side frame members each include a slot extending a distance parallel to a long axis of the side frame members and along an a surface facing outwardly from the side frame members, the slot receiving a protrusion on an accessory holder having a enlarged portion that is retained within the slot to couple the accessory holder to the side frame member.

15. The board of claim 9, wherein at least one of the foot members includes a handle member coupled thereto.

16. A collapsible, freestanding drawing board comprising:

a base having at least two foot members, at least one of the foot members including one or more storage receptacles integrally formed therein;

a frame mounted to the base, the frame having an upper frame member, a lower frame member and two side frame members, the upper frame member being selectively coupleable to the side frame members, and the lower frame member being releasably secured by the at least two foot members, wherein each foot member of the base has a first aperture for receiving an end of the lower frame member and a second aperture for securing one of the side frame members in a substantially vertical position, and wherein the side frame members each include a slot extending a distance parallel to a long axis of the side frame members and along an a surface facing outwardly from an opposite side frame member, the slot receiving a protrusion on an accessory holder having a enlarged portion that is retained within the slot to couple the accessory holder to the side frame member;

a sheet member having opposing side edges that include an enlarged portion relative to an adjacent portion of the sheet and the sheet member comprising a flexible fabric that is suitable for repeated uses as a marking surface; and means for coupling the sheet member to the frame comprising at least one slot formed in each of at least two opposing frame members for receiving the enlarged portions of the sheet member, and wherein the enlarged portion of the sheet member has a width dimension greater than a width dimension of a neck of each slot.

* * * * *